United States Patent [19]

Holzel

[11] 4,440,165

[45] Apr. 3, 1984

[54] CLOSED-CIRCUIT BREATHING APPARATUS

[76] Inventor: Thomas M. Holzel, 52 Lang St., Concord, Mass. 01742

[21] Appl. No.: 353,838

[22] Filed: Mar. 1, 1982

[51] Int. Cl.[3] ..... A62B 7/00

[52] U.S. Cl. ..... 128/205.28; 128/201.18; 128/201.25; 128/205.12

[58] Field of Search ..... 128/201.18, 202.25, 128/205.28, 205.12, 205.13, 205.17, 909

[56] References Cited

U.S. PATENT DOCUMENTS

| | | | |
|---|---|---|---|
| 1,225,269 | 5/1917 | Paul et al. | 128/205.12 X |
| 2,402,984 | 7/1946 | Browne | 128/205.13 |
| 2,403,981 | 7/1946 | Jackson et al. | 128/205.12 X |
| 3,658,058 | 4/1972 | Neidhart et al. | 128/201.18 |
| 3,976,063 | 8/1976 | Henndimer et al. | 128/201.25 |

FOREIGN PATENT DOCUMENTS

| | | | |
|---|---|---|---|
| 669841 | 1/1939 | Fed. Rep. of Germany | 128/201.18 |

OTHER PUBLICATIONS

Mine Safety Appliances Brochure, (7 pp.).
CSE Corporation Advertisement (1 p.).

*Primary Examiner*—Edward M. Coven
*Attorney, Agent, or Firm*—Cesari and McKenna

[57] ABSTRACT

A closed-circuit breathing apparatus includes an oxygen reservoir provided by flexible bags with open ends that can be rolled up and fastened in the rolled position to seal them. Oxygen is generated by a potassium superoxide canister that is activated by the water vapor in the exhaled breath of the user, and the oxygen generated is stored in the bag. The user breathes the oxygen from the bag, and flow of air through the system is controlled by simple check valves. Upward-directed passages are included in the air paths between a facemask and the check valves so that water droplets and ice are prevented from reaching the valves. The ice and water prevented from reaching the valves falls into a trap that can be easily cleaned in the field by removal of a plug.

16 Claims, 7 Drawing Figures

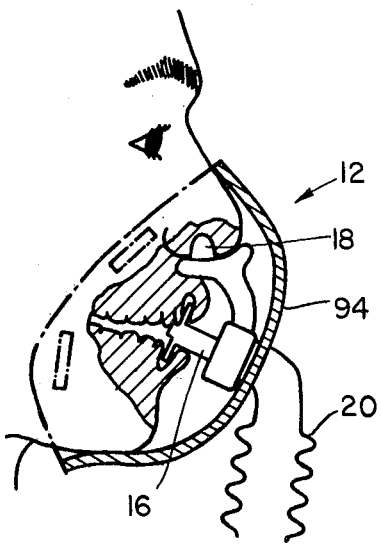
Fig. 5a
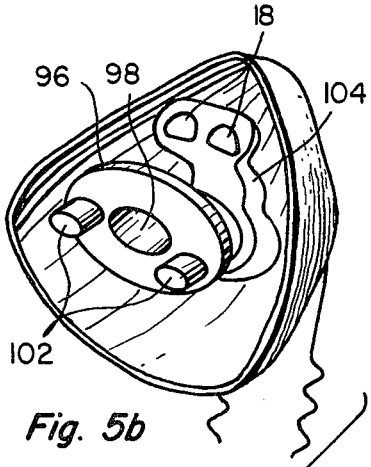
Fig. 5b
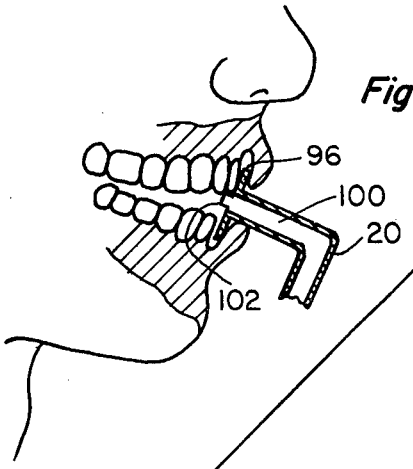
Fig. 5c
Fig. 5

CLOSED-CIRCUIT BREATHING APPARATUS

BACKGROUND OF THE INVENTION

The present invention is directed to oxygen breathing apparatus. It finds particular application in high-altitude terrain in which sub-freezing temperatures are expected.

Systems for supplementing the oxygen breathed by climbers have been employed in Himalayan mountaineering expeditions for some time. Most have been of the open-circuit, compressed-oxygen type. These systems allow the climber to operate more efficiently both mentally and physically than he would without the system.

With open-circuit systems, however, it is not feasible to raise the partial pressure of the oxygen in the lungs to that of air at sea level. Furthermore, the oxygen in such systems must be stored under high pressure, typically between 3500 and 4500 psi. This requires the use of pressure-reduction devices that have not always been reliable. Additionally, the use of high-pressure systems for military applications is not desirable because of the possibility that the pressure vessel could be pierced by projectiles, thereby exposing the soldier using the system to the additional hazard of an exploding vessel.

A further drawback of the open-circuit system is that it is by nature highly wasteful of oxygen. In the open-circuit system, air from the lungs is not recovered, and the exhausted air typically includes a considerable amount of oxygen. However, the air cannot be reused, because carbon dioxide is present in it and would build up as the air is rebreathed.

Some of these drawbacks have been avoided through the use of closed-circuit systems on Himalayan expeditions. These systems employ means for removing the carbon dioxide in the exhausted air, and the exhaust air can therefore be breathed again. In this manner, oxygen is not wasted, and the user can be supplied with nearly pure oxygen. In addition to saving oxygen, this type of an arrangement makes it feasible to keep the partial pressure of oxygen in the lungs equal to or even greater than the partial pressure that ordinarily obtains at sea level.

Unfortunately, the closed-circuit systems that have been used heretofore have not proved reliable. Few have operated properly for more than a few hours. They tend to be susceptible to various malfunctions, such as the icing up of valves and the contamination of the air supply by the ambient nitrogen. Once a malfunction has occurred, moreover, it normally cannot be remedied satisfactorily in the field.

It is accordingly an object of the present invention to provide simplicity and reliability in a closed-circuit oxygen-breathing apparatus that can easily be serviced in the field.

SUMMARY OF THE INVENTION

The foregoing and related objects are achieved in a closed-circuit breathing apparatus that includes an air-purification element for reducing the carbon dioxide content and increasing the oxygen content of the air that passes through it. The user breathes into a facemask from which his exhaled breath is conducted to the air-purification element by a conduit. The exhausted air flows through the air-purification element to a reservoir for storing the oxygen-enriched air. The conduit connecting the facemask to the air-purification element is also connected to the reservoir, and the oxygen-enriched air flows from the reservoir through the conduit to the facemask when the user inhales.

The reservoir can be opened to permit access to its interior so that the user can clear it of unwanted foreign matter, such as ice.

According to another aspect of the invention, upward-directed portions are provided in the conduit ahead of check valves in the conduit so that ice and liquid water will be trapped and will not reach the check valves to foul them.

The invention is set out with more particularity in the appended claims.

BRIEF DESCRIPTION OF THE DRAWINGS

These and further features and advantages of the present invention are described in connection with the accompanying drawings, in which:

FIG. 5*a* is a side elevation, partially broken away, of the facemask used in the present invention;

FIG. 5*b* is a perspective view of the facemask of FIG. 5*a;* and

FIG. 5*c* is a side sectional view of the conduit portion of the facemask.

DETAILED DESCRIPTION OF THE PREFERRED EMBODIMENT

Figure 1:
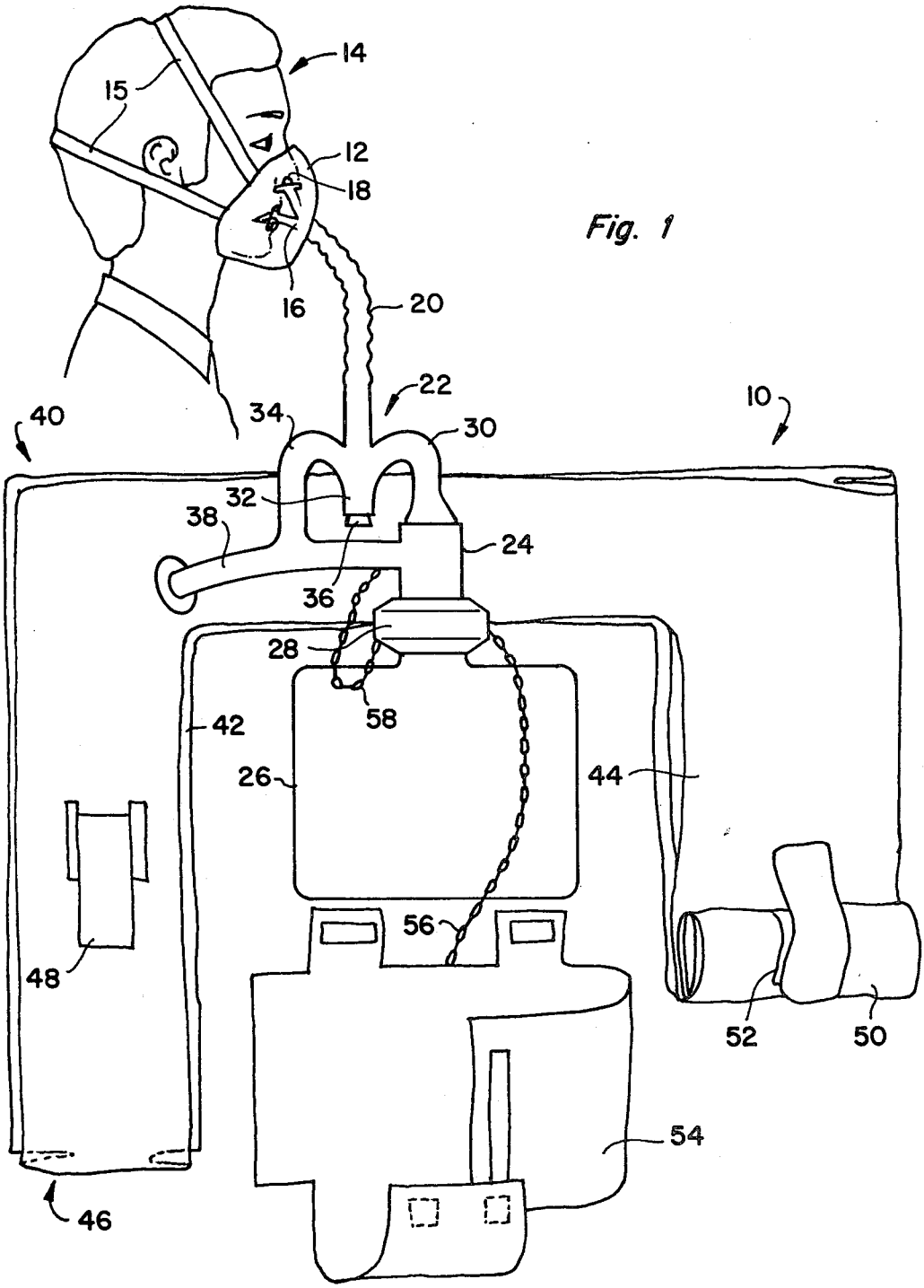
FIG. 1 is a somewhat diagrammatic representation of the breathing apparatus of the present invention.
Figure 4:
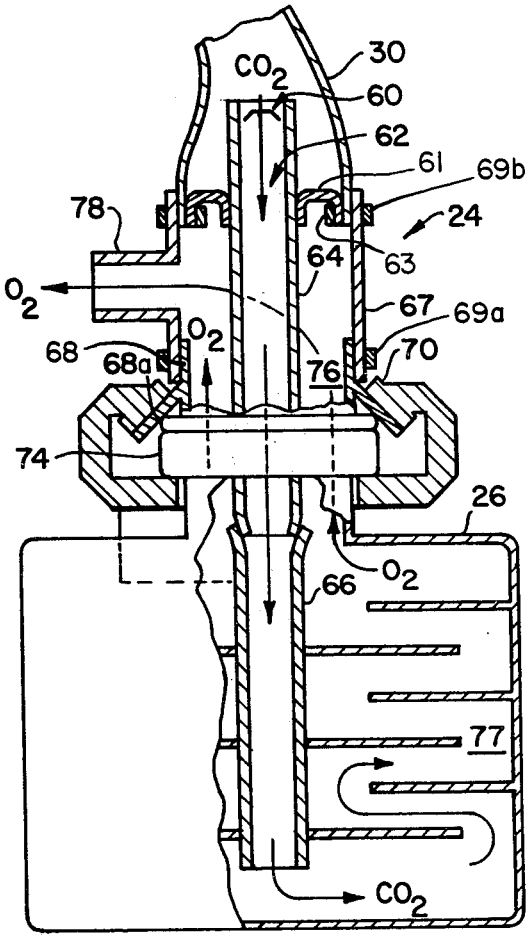
FIG. 4 is a cross-sectional view of a plunger assembly in position on the canister.

FIG. 1 depicts a closed-circuit oxygen-breathing apparatus embodied in accordance with this invention that employs an air-purification element in the form of a chemical canister 26 to which exhaust air from a user 14 is directed by a hose 20 and a manifold 22. As FIG. 4 shows, the exhaled air enters canister 26 through a coaxial tube 66, and the air has its carbon dioxide content reduced and its oxygen content increased through reaction with the chemicals in canister 26. The enriched air then leaves the canister through an outer annulus 76 (FIG. 4) and an output port 78 of plunger assembly 24 to enter a breathing bag 40. When the user inhales, enriched air passes from the breathing bag 40 (FIG. 1) through the intake side 34 of the manifold to the facemask 12 to be breathed by user 14.

A more detailed perusal of FIG. 1 reveals that breathing apparatus 10 terminates at its upper end in a facemask 12 that is held in place on the head of a user 14 by suitable headstraps 15. The user assists in holding it in place by means of a bite piece 16, and noseplugs 18 are included as part of the facemask to prevent loss of the air from the closed circuit through the nose of the user 14.

A flexible hose 20 leads from facemask 12 to manifold 22, the outlet of which is suitably connected to a plunger assembly 24. When it is assembled for operation, plunger assembly 24 is sealingly seated on chemical canister 26 and held in sealing relationship by a clasp 28.

The manifold 22 includes an exhaust portion 30 that curves upward from a trap portion 32 so that exhaled air flowing down through hose 20 is required to flow in an upward direction through part of its path to reach plunger assembly 24 and canister 26. A complementary intake portion 34 is similarly shaped. The result is that ice particles or water droplets in the exhaled air are largely trapped in trap portion 32. There is an opening at the lower end of trap 32 that is stopped with a removable plug 36. Removal of plug 36 allows ice and water to be cleared from the trap, but plug 36 must be replaced during operation after the trap is cleared so that the air circuit will remain closed.

A section of tubing 38 extends from a laterally-extending port of plunger assembly 24 to the interior of breathing bag 40 and also forms a "T" with inlet portion 34 of manifold 22.

Tube 38 conducts enriched air from plunger assembly 24 and directs it, by means of valving described below, either to inlet portion 34 of manifold 22 or to the interior of breathing bag 40. Tube 38 also conducts air back from the interior of reservoir 40 to intake portion 34 of manifold 22.

Breathing bag 40 is a generally U-shaped flexible bag having two leg portions 42 and 44, which are substantially identical to each other. Each is easily accessible to the user's hands and made of flexible material that expands and contracts with breathing and can be squeezed to expel the air from the inside of the bag. When unrolled, each leg has an opening 46 at its lower end that is large enough to provide access by a mittened hand to the interior of bag 40. Since it is intended that the apparatus will be used in cold weather, it can be anticipated that water vapor in the exhaled air will condense and possibly freeze inside bag 40. The opening at the lower end of bag 40 thereby affords the user of means of clearing accumulated water and ice from the bag.

Bag 40 also includes two flaps such as flap 48, which provides one of the components of a hook-and-loop fastener of the type sold under the mark VELCRO. In normal use, leg portion 42 would be rolled up to form a roll such as roll 50 illustrated on leg portion 44. The reverse side of leg portion 42 includes a complementary portion of a hook-and-loop fastener similar to patch 52 of leg portion 44. This hook-and-loop fastener would secure the roll in place to seal the lower end of the bag and prevent any significant loss of air. The hook-and-loop fastener and the rolled-up end consititute a particularly simple arrangement for providing an access opening and a means for sealing it, but other means for carrying out these functions can also be used.

Also provided is an insulating bag 54 that fits around canister 26 and is attached to plunger clasp 28 by an appropriate chain 56. A further chain 58 connects clasp 28 to the breathing bag.

Figure 2:
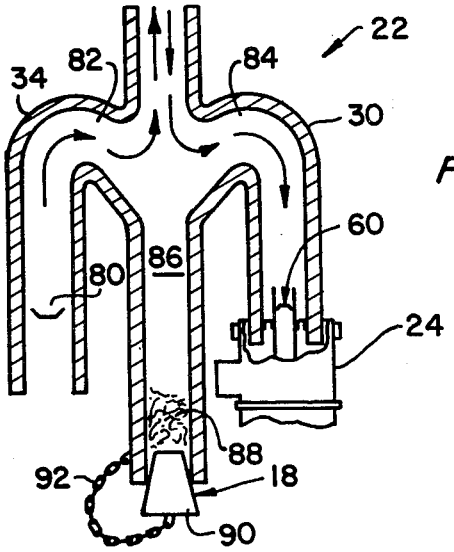
FIG. 2 is a simplified cross-sectional view of the manifold employed in the device of FIG. 1.

FIGS. 2 and 4 show the path by which air exhaled by the user reaches canister 26. Air in the exhaust leg 30 of manifold 22 can only flow in one direction because a check valve 60, which allows air to flow downward past it but not upward, is disposed in the inlet 62 (FIG. 4) of plunger assembly 24. An annular seal 61 prevents flow around inlet 62 and is held in place by an O-ring 63. Air that has entered this inlet is directed down through the interior of an interior stem 64 and from there into a vertical tube 66 that is coaxial with stem 64 and directs the flow of air to the bottom of canister 26. Interference between the ends of stem 64 and tube 66 causes resilient deformation to provide a seal between them.

Figure 3:
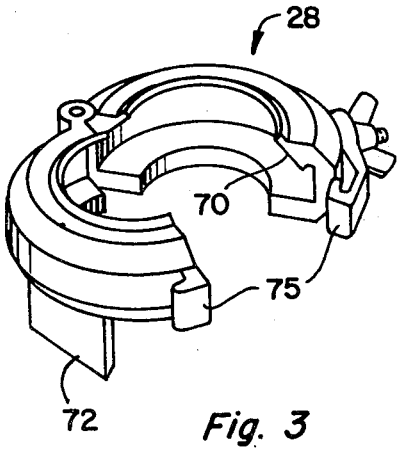
FIG. 3 is a perspective view of a clasp that is used to hold the plunger assembly in place.

FIG. 4 also reveals that plunger assembly 24 includes a cylindrical housing 67 that encloses a seating piece 68 with a generally frustoconical seat portion **68*a*. Appropriate clasps 69*a* and 69*b* secure housing 67 to seating piece 68 and seal 61, respectively. Seat portion 68*a* engages a lip 74 formed at the upper end of the canister inlet, and clasp 28 (FIG. 3) envelops seat portion 68*a* of plunger assembly 24. The interior surface of clasp 28 includes a complementary frustoconical bearing plate 70 (FIG. 3) that bears against seat portion 68*a*. Seat portion 68*a* is thereby held in sealing relationship against lip 78 of canister 26 when clasp 28 is held in its closed position by a suitable latch 75**.

A downward-extending index tab 72 (FIG. 3) is provided on clasp 28 and extends downward behind canister 26 to keep it in the proper orientation with respect to manifold 22.

The exterior of interior stem 64 and the interior of housing 67 form a generally annular interior passage 76. In order to reach passage 76 from the lower end of canister 26, air must pass through passages 77 in the canister interior. In these passages, the air is brought into contact with potassium superoxide ($KO_2$), which reacts with the water vapor in the exhaled breath. Most of the carbon dioxide is thereby removed, and the oxygen content is increased. The canister employed for this purpose is of the type manufactured, for instance, under the mark CHEMOX by Mine Safety Appliances of Pittsburgh, Pa. This type of air-purification element is preferred for many applications because of its simplicity. However, many of the objects of the invention can be achieved even if other types of air-purification elements are used. For example, an air-purification element including an oxygen source, such as a container of compressed oxygen, that is separate from the carbon dioxide scrubber may be desired in some instances.

After having traversed passages 77, the air, which is now enriched and ready to be breathed again, flows through annulus 76 and an output port 78 of plunger assembly 24 to a tubing portion 38 (FIG. 1).

Tubing portion 38 leads both to the inlet leg 34 of manifold 22 and to the interior of breathing bag 40. The route taken by the enriched air from outlet 78 of plunger assembly 24 depends on the state of an input check valve 80 (FIG. 2) in the intake leg 34 of manifold 22. Like check valve 60, check valve 80 responds to the difference in pressure across it. When the user is inhaling, the pressure above valve 80 tends to be slightly less than that below it, and check valve 80 accordingly opens, permitting air to flow up intake leg 34. The air flowing into intake leg 34 typically comes both from breathing bag 40, which acts as a reservoir for enriched air, and from outlet 78 of canister 24. Accordingly, the user breathes in enriched air. Since the air is nearly all oxygen, the resulting partial pressure of oxygen in the user's lungs can be equal to or greater than that of air at seal level even though the total pressure of the atmosphere at his altitude is relatively low. At the same time, exhaust check valve 60, which is oriented in the direction opposite to that in which valve 80 is oriented, is operated to its closed position, so the user does not breath in air coming from the exhaust side of canister 26.

Thus, the conduit arrangement of the breathing apparatus has an intake passage that includes a tube 38 and the intake leg of manifold 22 as well as flexible hose 20 and trap 32 of manifold 22. The hose and trap are also parts of an exhaust passage that further includes exhaust leg 30 of manifold 22.

Among the advantages of the breathing apparatus disclosed in the drawings is that it is arranged to minimize the incidence of valve clogging due to ice buildup. The valves are disposed in vertical conduit sections, so they are less susceptible to foreign-matter buildup than they would be if they were disposed in horizontal sections. Furthermore, the intake and exhaust passages include vertical sections 82 and 84 (FIG. 2) that make it necessary for air coming from the user's mouth to either of the valves to travel through an upward-extending portion. As a result, water vapor that has condensed or frozen on the way to manifold 22 is largely prevented from reaching either of the check valves 60 and 80. Instead, the liquid water or ice would ordinarily fall into a trap portion 32 (FIG. 2) of manifold 22, which is common to both vertical sections 82 and 84. In trap portion 32, the ice and liquid water would not interfere with the operation of either check valve but would form a harmless mass 88. If the mass of ice 88 grew too large, however, it might block the passages to the valves. In order to prevent this, it is only necessary for the user to remove a plug 90 that stops an opening at the bottom of trap 86. The ice can thus be readily removed and the plug 90 replaced to restore the closed-circuit operation. To prevent loss of the plug while the trap is being cleared, a chain 92 is provided by which the plug 92 hangs from manifold 22.

It will be explained below that leakage into and out of the system is not catastrophic. It is nonetheless desirable to keep it to a minimum. Toward this end, facemask 12, which is illustrated in FIG. 5, is designed to minimize losses of oxygen from the system and leakages of nitrogen into the system.

Facemask 12 includes a flexible cover piece 94 shaped to seal against the face of the user. Protruding inward from it is a bite piece 16 that terminates in an oval disk 96 having an opening 98 that communicates with the interior 100 of hose 20. Extending from disk 96 are two projections 102 that are adapted to be bit by the user to hold the facemask in place. Additionally, the disk is held in place by the user's lips. Extending generally upward from bite piece 16 is a flexible nose-plug stem 104 from which two nose-plug protuberances 18 project. Protuberances 18 are tapered to accommodate a wide range of nostril sizes, and stem 104 is resiliently deformable so that insertion of the bite piece automatically causes the protuberances to plug the nostrils of the wearer. Because of the flexibility of stem 104 and the tapered shape of protuberances 18, the nostril plugging will be effected automatically on users having a rather wide range of facial features.

The combination of the bite piece and nose plug keeps the system substantially closed even when the sealing with the user's face of cover 94 is not complete, as it is likely not to be in situations in which the user is bearded. The prevention of air flow through the nose is achieved without an exterior clip, so hindrance to blood circulation in the nose is minimal. This is important in cold weather, when hindrance to blood flow makes frostbite more likely.

In operation, the user initially attaches a new air-purification element 26 to plunger assembly 24 and latches clasp 28 around them to hold the canister in place. The insulating bag 54 is then used to cover canister 26. With the legs 42 and 44 of breathing bag 40 in their rolled-up conditions, the user places facemask 12 in position on his face, simultaneously inserting bite-piece 16 in his mouth. For most users, plugs 18 seat automatically into the user's nostrils as a result. The user holds the mask in place by means of straps 15 and bite piece 16 and then merely breathes normally. Exhalation opens exhaust check valve 60 and closes intake check valve 80, and air therefore flows down hose 20, through the exhaust leg 30 of manifold 22, and into the interior of central stem 64 of plunger assembly 24. The seating of stem 64 in the coaxial tube 66 prevents the air from passing directly to the annulus 76 in the interior of plunger assembly 24. Instead, it flows to the lower end of tube 66 and must pass through passages 77 in order to reach annulus 76. By doing so, the air has its carbon dioxide removed and its oxygen content increased. The enriched air passes through annulus 76 and tube 38 and fills breathing bag 40. Accordingly, a reservoir of oxygen is provided by breathing bag 40.

When the user inhales, valve 60 closes and valve 80 opens to permit the user to breathe in air from breathing bag 40. It can be seen that the pressure-difference action of valve 80 results in only ambient pressure in breathing bag 40, so, if the user is at a high altitude, he is breathing "thin" air. However, the air in bag 40 normally is nearly all oxygen. Therefore, so long as the total ambient pressure is at least as great as the sea-level partial pressure of oxygen, the partial pressure of the oxygen in the user's lungs can be equal to, or even greater than, the partial pressure of oxygen that he would normally enjoy at sea level.

Check valves 60 and 80 are both made of flexible material, as are manifold sections 30 and 34. The portion of stem 64 in which valve 60 is mounted is also flexible. Consequently, it is possible for the user to resiliently deform valves 60 and 80 by squeezing the portions of manifold sections 30 and 34 that are disposed around them. Furthermore, hose 20 and manifold 22 generally are both flexible, so they can also be resiliently deformed as a result of squeezing by the user. This is a beneficial feature because it allows any ice that has been built up in any of these portions of the circuit to be dislodged by simple squeezing of the various parts. Thus, problems resulting from the build-up of foreign matter, which can incapacitate many other breathing devices until they can be given attention at a maintenance facility, are easily remedied in the field when the teachings of the present invention are employed.

Although the system is substantially closed, extended use may result in leakage of nitrogen from the surrounding atmosphere into breathing bag 40. The rate at which nitrogen leaks into the bag is presumably much lower than that at which oxygen is produced in canister 26, but the oxygen is consumed in the user's metabolism, while the nitrogen merely passes through the system. After a while, therefore, the contents of breathing bag 40, instead of being nearly all oxygen, can have significant quantities or even a majority of nitrogen. This, of course, would reduce the partial pressure of oxygen in the user's lungs, defeating the purpose of the breathing apparatus.

With the apparatus of the present invention, this situation is easily remedied. If the user suspects that the air that he is breathing has a significant nitrogen content, he merely removes the facemask momentarily and squeezes breathing bag 40 to cause its contents to flow through tube 38, intake leg 34, and tube 20 and out facemask 12. This substantially eliminates the nitrogen content of the breathing bag. At the same time, the user exhales as fully as possible, eliminating to the extent possible the nitrogen inventory in his lungs. He then replaces the facemask and begins breathing as before. Canister 26 soon completely fills bag 40 with oxygen again, and the partial pressure of oxygen in the user's lungs is restored to the desired level.

An extended term of use of the system typically will also result in a collection of water or ice in breathing bag 40. Retention of water or ice in bag 40 is desirable because water vapor that condenses in breathing bag 40 is not available to clog the breathing lines and foul valves 60 and 80. However, the collection of ice in the bag will, over time, significantly reduce the air volume in the reservoir. It is among the advantages of the present invention that the user can easily remove the ice from bag 40 while he is in the field; it is not necessary for him to return the breathing apparatus to a repair center for servicing.

In order to remove the ice from bag 40, the user merely pulls the tabs 48 of the hook-and-loop fasteners and allows legs 42 and 44 to unroll. He then reaches inside openings 46 and clears out the ice with his hand. This simple operation accomplished, he rolls the bags back up, fastens them, and then squeezes the bags as before to expel the nitrogen that has entered the bags while the ice was being removed. It may also be desired at the same time to remove accumulated ice from manifold 22 by crushing and shaking it to cause it to fall to trap 32 and then removing plug 36 in the manner described above.

From the foregoing description, it will be apparent that the breathing apparatus of the present invention eliminates many of the drawbacks of prior-art devices. As a closed-circuit device, the disclosed apparatus can achieve an oxygen partial pressure in the lungs at all terrestrial altitudes that is as great or greater than the partial pressure of oxygen ordinarily experienced at sea level. If the oxygen is generated chemically in response to the user's breathing, as it is in the illustrated embodiment, no dangerous pressure vessels are required, and there is no need for any complicated pressure-regulating devices. Furthermore, since the oxygen reservoir is in the form of an easily accessible bag that can be relieved of accumulated nitrogen by merely squeezing it, excessive attention does not need to be paid to preventing the entrance of nitrogen, and when the nitrogen does enter, the situation can be easily remedied in the field. Accordingly, a significant advance is represented by the breathing apparatus of the present invention.

What is claimed as new and desired to be secured by Letters Patent of the United States is:

1. A closed-circuit breathing apparatus comprising

A. an air-purification element, having an inlet and an outlet, for permitting the flow of air through it from its inlet to its outlet and for reducing the carbon dioxide content and increasing the oxygen content of the air passing through it;

B. reservoir means for storing oxygen-enriched air, said reservoir means being adapted to be opened from a closed state, in which it stores oxygen-enriched air, to an open state, in which it provides an opening large enough to permit a user to insert his hand into the interior of the reservoir means;

C. means for providing fluid communication between the outlet of said air-purification element and the interior of said reservoir means and thereby permitting air to flow from said air-purification element into said reservoir means;

D. facemask means adapted to fit over the nose and/or mouth of a user; and

E. conduit means separately connected to said facemask means, to said inlet of said air-purification element, and to the interior of said reservoir means, said conduit means including:

(1) an exhaust flow passage for providing fluid communication between said facemask means and said inlet of said air-purification element; and (2) an intake flow passage for providing fluid communication between the interior of said reservoir and said facemask means, said intake flow passage including at least a portion thereof that is separate from said exhaust flow passage, said separate portion including an intake check valve therein for permitting the flow of air from said reservoir to said facemask but not from said facemask to said reservoir.

2. A closed-circuit breathing apparatus as recited in claim 1 wherein said reservoir is provided by a collapsible bag having an opening therein, said bag being adapted to be rolled up around said opening to seal said opening, said reservoir means further including fastener means on said bag for securing said bag in the rolled-up condition for normal use but being readily opened by the wearer to permit the roll to be released to afford access to the interior of said reservoir through said opening in said bag.

3. A closed-circuit breathing apparatus as recited in claim 2 wherein said fastener means is of the hook-and-loop variety.

4. A closed-circuit breathing apparatus as recited in claim 3 wherein said bag is at least partially free from exterior obstruction to permit manual access and squeezing of said bag by the user to expel unwanted nitrogen from said reservoir.

5. A closed-circuit breathing apparatus as recited in claim 2 wherein said bag is at least partially free from exterior obstruction to permit manual access and squeezing of said bag by the user to expel unwanted nitrogen from said reservoir.

6. The closed-circuit breathing apparatus of claim 2 wherein said check valve and the portion of the conduit means in which it is disposed are resiliently deformable to permit resilient deformation of said check valve, whereby ice accumulated on said check valve will tend to be freed from it by manual squeezing of said conduit means at the position of said check valve.

7. The closed-circuit breathing apparatus of claim 6 wherein said conduit means is resiliently deformable along at least the greater portion of its length to permit resilient deflection by manual squeezing by the user, manual squeezing thereby tending to free ice that has accumulated in the passages of said conduit means.

8. A closed-circuit breathing apparatus as recited in claim 1 wherein said reservoir is provided by a collapsible bag that is at least partially free from exterior obstruction to permit manual access and squeezing by the user to expel unwanted nitogen from the interior of said bag.

9. The closed-circuit breathing apparatus of claim 8 wherein said check valve and the portion the portion of the conduit means in which it is disposed are resiliently deformable to permit resilient deformation of said check valve, whereby ice accumulated on said check valve will tend to be freed from it by manual squeezing of said conduit means at the position of said check valve.

10. The closed-circuit breathing apparatus of claim 9 wherein said conduit means is resiliently deformable along at least the greater portion of its length to permit resilient deflection by manual squeezing by the user, manual squeezing thereby tending to free ice that has accumulated in the passages of said conduit means.

11. The closed-circuit breathing apparatus of claim 1 wherein said check valve and the portion of the conduit means in which it is disposed are resiliently deformable to permit resilient deformation of said check valve, whereby ice accumulated on said check valve will tend to be freed from it by manual squeezing of said conduit means at the position of said check valve.

12. The closed-circuit breathing apparatus of claim 11 wherein said conduit means is resiliently deformable along at least the greater portion of its length to permit resilient deflection by manual squeezing by the user, manual squeezing thereby tending to free ice that has accumulated in the passages of said conduit means.

13. A closed-circuit breathing apparatus comprising

A. an air-purification element, having an inlet and an outlet, for permitting the flow of air through it from its inlet to its outlet and for reducing the carbon dioxide content and increasing the oxygen content of the air passing through it;

B. reservoir means for storing oxygen-enriched air;

C. means for providing fluid communication between the outlet of said air-purification element and the interior of said reservoir means and thereby permitting air to flow from said air-purification element into said reservoir means;

D. facemask means adapted to fit over the nose and/or mouth of a user; and

E. conduit means separately connected to said facemask means, to said inlet of said air-purification element, and to the interior of said reservoir means, said conduit means including an exhaust flow passage for providing fluid communication between said facemask means and said inlet of said air-purification element and an intake flow passage for providing fluid communication between said facemask and said reservoir interior, at least a portion of each of said exhaust and intake flow passages being separate from the other of said exhaust and intake flow passages, said separate portion of said intake flow passage providing the fluid communication with the interior or said reservoir means and including an intake check valve that permits flow of air from said reservoir to said facemask but prevents air flow from said facemask to said reservoir, said separate portion of said exhaust flow passage providing the fluid communication with said inlet of said air-purification element and including an exhaust check valve that permits air to flow from said facemask means to said inlet of said air-purification element but prevents the flow of air from said inlet of said air-purification element to said facemask means, said exhaust flow passage including an upward-directed portion upstream of said exhaust check valve in which air flowing from said facemask means to said air-purification element is constrained to flow upward when the user of the breathing apparatus is standing in a normal upright position, the amount of ice and liquid water carried by the air to said exhaust check valve thereby normally being reduced by the force of gravity.

14. A closed-circuit breathing apparatus as recited in claim 13 wherein said conduit means provides an opening near the bottom of said upward-directed portion of said exhaust passage and includes a plug that is disposed in said opening to seal it but is removable to permit removal of water or ice that has collected at the bottom of said upward-directed portion.

15. A closed-circuit breathing apparatus as recited in claim 13 wherein the path in said intake flow passage from said facemask means to said intake check valve includes a portion that is directed upward when the user is in a normal, upright position, the amount of ice and liquid water reaching said intake check valve thereby normally being reduced by the force of gravity.

16. A closed-circuit breathing apparatus as recited in claim 15 wherein said upward-directed portions of said intake and exhaust passages have a common lower trap portion and wherein said conduit means provides an opening in said trap portion and includes a removable plug by which water or ice collected in said common trap portion may be removed by removal of said plug.

* * * * *